US005820729A

United States Patent [19]

Ericsson et al.

[11] Patent Number: 5,820,729

[45] Date of Patent: Oct. 13, 1998

[54] DEVICE AND PROCESS FOR DISSOLVING SMELT FROM RECOVERY BOILERS

[75] Inventors: Tommy Ericsson, Nol; Sven-Erik Jansson, Göteborg, both of Sweden

[73] Assignee: Kvaerner Pulping AB, Sweden

[21] Appl. No.: 849,429

[22] PCT Filed: Nov. 15, 1995

[86] PCT No.: PCT/SE95/01355

§ 371 Date: Aug. 12, 1997

§ 102(e) Date: Aug. 12, 1997

[87] PCT Pub. No.: WO96/16225

PCT Pub. Date: May 30, 1996

[30] Foreign Application Priority Data

Nov. 22, 1994 [SE] Sweden ..... 9404028

[51] Int. Cl.[6] ..... D21C 11/12

[52] U.S. Cl. ..... 162/30.1; 162/30.11; 162/62; 422/185; 422/236

[58] Field of Search ..... 162/29, 30.11, 162/30.1, 61, 62, 238, 263; 422/255, 236, 185, 3, 50; 210/105

[56] References Cited

FOREIGN PATENT DOCUMENTS

0524743 A1 1/1993 European Pat. Off. .

OTHER PUBLICATIONS

Lavigne, John R., "Instrumentation . . . Paper Industry", Miller Freeman Publications, pp. 120–125, 1979.

Frederick, W.J., "Pirssonite . . . Processing", Tappi Journal vol. 73, No. 2, pp. 135–140, Feb. 1990.

Tappi Journal, vol. 73, No. 2, Feb. 1990, W.J. Frederick, Jr., et al, "Pirssonite deposits in green liquor processing", pp. 135–140.

*Primary Examiner*—Stanley S. Silverman
*Assistant Examiner*—Dean T. Nguyen
*Attorney, Agent, or Firm*—Fasth Law Offices; Rolf Fasth

[57] ABSTRACT

The invention relates to a device for dissolving smelt chemicals from recovery boilers, a so-called soda smelt dissolver, and to a process for such dissolution using the device. The device is characterized in that it consists of at least two separate dissolving tanks (I, II), which are connected to each other near the bottom, via a connecting pipe (3), to allow free flow of liquid between them, and of devices for the separate supply to each tank of dissolving liquid and smelt chemicals in dependence on the measured and established chemical concentration in the solution in each of the tanks (I, II), wherein the outlets from the tanks (I, II) can be separately shut off and regulated. The process according to the invention involves using the device and switching over the functions of the different tanks.

12 Claims, 1 Drawing Sheet

DEVICE AND PROCESS FOR DISSOLVING SMELT FROM RECOVERY BOILERS

TECHNICAL FIELD

The present invention relates to a device for dissolving smelt chemicals from recovery boilers, a so-called soda smelt dissolver, and also to a process for dissolving such chemicals using the device according to the invention, with the principal advantage of the device and the process being that plugging and coating of the device are prevented as a result of the deposition of pirssonite being decreased.

STATE OF THE ART

When concentrated spent liquor, so-called black liquor, from cellulose production is combusted in recovery boilers, smelt chemicals are obtained which are tapped off from the recovery boiler and down into a so-called soda smelt dissolver. This soda smelt dissolver consists of a tank which is preferably elongate, and which is equipped with devices for supplying smelt chemicals and liquid for dissolving the chemicals, which liquid is normally in the form of so-called weak liquor, which is a dilute aqueous alkaline solution which comes from the lime treatment. Normally, the temperature of the smelt is in the region of 800° C. and that of the weak liquor is 70°–80° C. The temperature of the solution in the soda smelt dissolver is approximately 95° C. The soda smelt dissolver is provided with stirring devices and with spraying devices for adding the smelt so that the latter, which is at a high temperature, does not produce too violent a reaction when it meets the surface of the liquid, which is at a substantially lower temperature. For tapping it, the tank is provided with two outlet pipes which are placed at a distance from each other.

However, one of the pipes can alternately be used as an inlet pipe for weak liquor while the other is used as an outlet pipe for the solution, so-called green liquor.

TECHNICAL PROBLEM

A continually recurring problem associated with soda smelt dissolvers is that pipes and valves have a tendency to become plugged with solid matter and that the stirrers also become coated with such matter. This solid matter principally consists of pirssonite, which is a chemical combination of sodium carbonate and calcium carbonate. While the sodium carbonate derives in the main from the chemical smelt, the calcium carbonate arrives in the soda smelt dissolver together with the weak liquor. Deposition of this double salt depends partly on the concentration and partly on the temperature of the solution. The higher the concentration of alkali and the lower the temperature of the solution, the more pirssonite is deposited. This problem is described, for example, by W. J. Frederick Jr. and Rajeev Krishnan and also Russell J. Ayers, in the article Pirssonite Deposits in Green Liquor Processing in the journal Chemical Recovery 1989, pp. 151–156. The need to decrease, or completely eliminate, this deposition problem in soda smelt dissolvers has therefore existed for a long time.

SOLUTION

In accordance with the present invention, therefore, the abovementioned problem has been solved and a device for dissolving smelt chemicals from recovery boilers, a so-called soda smelt dissolver, has been produced, which device includes devices for supplying smelt chemicals and dissolving liquid and also outlets for the resulting solution, which device is characterized in that it consists of at least two separate dissolving tanks, which are connected to each other near the bottom to allow free flow of liquid between them, and of devices for the separate supply to each tank of dissolving liquid and smelt chemicals in dependence on the measured and established chemical concentration in the solution in each of the tanks, wherein the outlets from the tanks can be separately shut off and regulated.

According to the invention, the device for supplying dissolving liquid includes a separate conduit from which branches pass to the different tanks by way of an adjustment valve.

According to the invention, it is expedient for each tank to be provided with an outlet pump which can be regulated separately.

According to the invention, the devices for measuring the concentration and the level in the tanks comprise so-called bubble pipes.

The invention also includes a process for dissolving smelt chemicals from recovery boilers using the device according to the invention, and the process is characterized in that the set point for the concentration of chemicals in the solution is adjusted to different levels in the separate tanks and in that the outflow from the tanks, which are in flow connection with each other, takes place only from the tank which has the highest set point.

According to the invention, the set points in the different tanks can be switched alternately, expediently once every twenty-four hours.

According to the invention, one of the set points is expediently adjusted to be twice as high as the other.

According to the invention, it can be expedient to arrange for the supply of the smelt chemicals to the separate tanks to be approximately equal, with the majority of the dissolving liquid being supplied to the tank which has the lowest set point.

According to the invention, the procedure on changing the set points and altering the direction of flow in the connecting pipe between the tanks is first to raise the lower set point to the higher level, after which, when the concentration in the solution has reached this set point as the result of decreased supply of dissolving liquid to this tank, the outlet device of this tank is activated and that of the other tank is inactivated at the same time as the set point for this latter tank is lowered and the influx of dissolving liquid to this tank is thereby increased.

According to the invention, the process and the alternation between the tanks can take place automatically.

DESCRIPTION OF THE FIGURES

The invention will be described in more detail below with reference to the attached figures in which FIG. 1 is a diagrammatic representation of a vertical section through a tank system according to the invention, and in which

DETAILED DESCRIPTION

Figure 1:
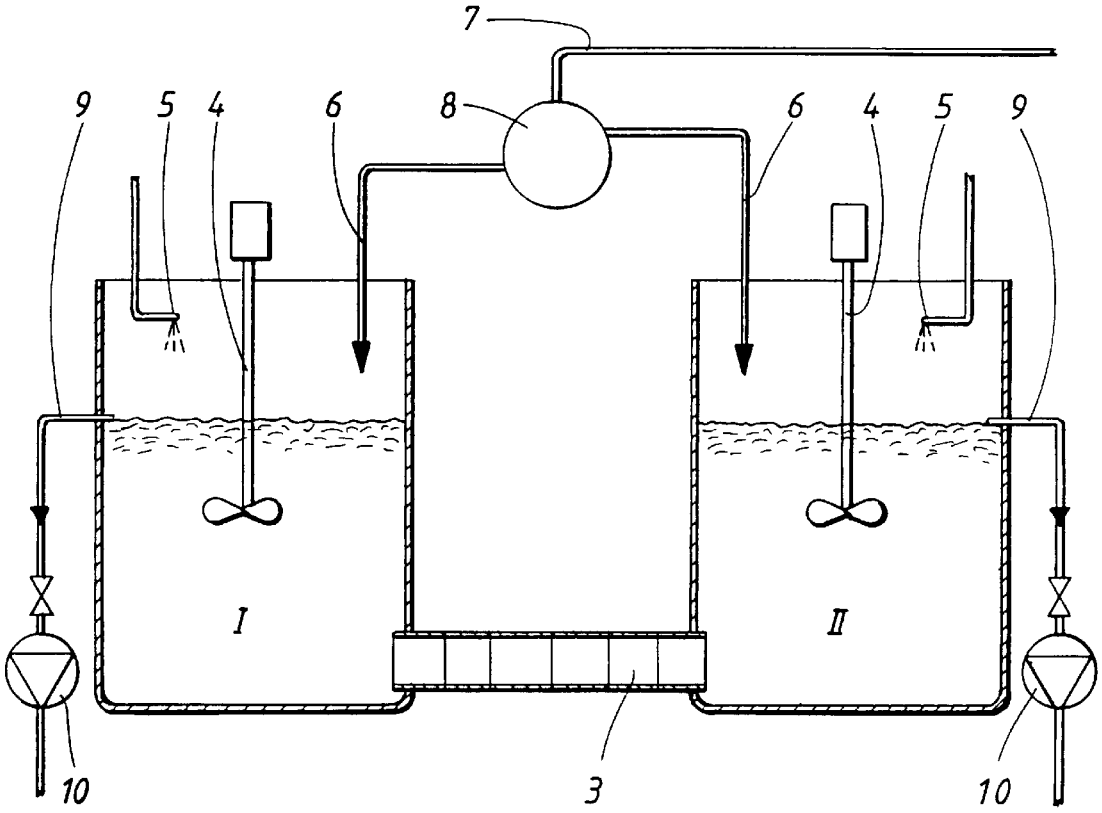

FIG. 1 is a diagrammatic representation of a section through the soda smelt dissolver according to the invention, which consists of the tanks I and II which, at their lower parts, are connected by means of a pipe 3, which pipe 3 enables free flow to take place between tanks I and II. Both these tanks I and II are provided with stirrers 4. In addition, they possess devices 5 for the supply of smelt chemicals from a recovery boiler. The devices 5 for supplying the smelt are conventional per se and are arranged so that the smelt, which is at a temperature of 800°–900° C., is broken up in a spray shower by means of steam being sprayed against it. This is done in order to dampen the noise and powerful reactions which otherwise occur when the hot smelt meets the surface of the liquid, the temperature of which is less than 100° C. Devices 6 for supplying dissolving liquid, preferably in the form of so-called weak liquor, are also arranged in each tank I and II. The weak liquor, which comes from the calcination, which is included in every system for recovering chemicals in recovery boilers, contains a certain amount of calcium which, together with the smelt chemicals, which principally consist of sodium carbonate, sodium sulphide and a small quantity of sodium sulphate, can result in pirssonite being deposited. According to the invention, the supply of weak liquor through pipes 6 is to be alternated from tank to tank and, for this reason, a common pipe 7 has been arranged for this supply, which pipe 7 opens out in a valve 8 from which the lines 6 branch off. While the temperature of the weak liquor is normally 70°–80° C., it can be cooled down to a temperature of approximately 50°–60° C. As a consequence, problems of reaction or heat evolution do not arise when this weak liquor meets the surface of the solution.

In addition, both the tanks are provided with outlet openings 9 which expediently include a pump 10. The liquid which is withdrawn from one of the tanks I or II, and which contains the dissolved chemicals, is termed green liquor. While it can be withdrawn through overflows in one of the tanks, it can also be withdrawn at a lower level, with the outflow then being regulated by means of the pump 10. The latter case is to be preferred.

Figure 2:
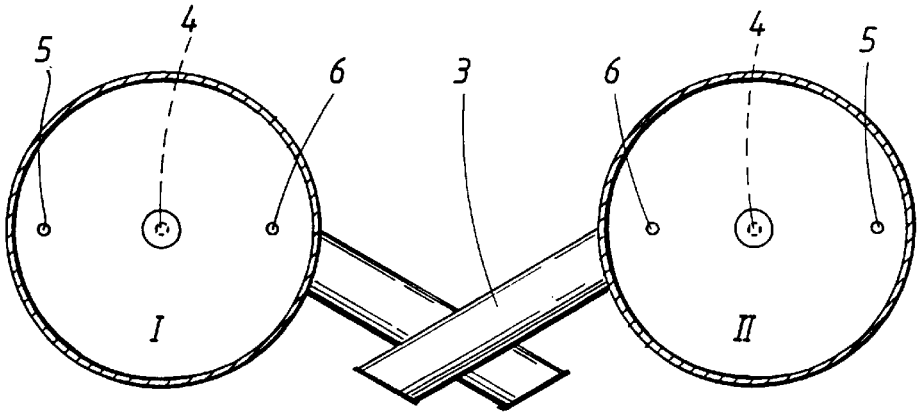
FIG. 2 shows the tank system as seen from above.

FIG. 2 is a diagrammatic representation of a device according to the invention as seen from above. The same reference numbers apply to this figure as to FIG. 1. The connecting line 3 between the tanks is expediently designed in the manner shown in the figure so that mechanical cleaning can be effected if, contrary to expectation, the pipes should become plugged.

Measuring equipment of a conventional type is present in each tank in order to measure the concentration of the chemicals and the level of the surface of the liquid. This measuring equipment expediently consists of so-called bubble pipes and is not described in any more detail here since these pipes are not included in the actual invention.

When the device according to the invention is to be used, smelt 5 is expediently supplied in equal quantities to both the tanks. While there is no objection per se to the two tanks being supplied with different quantities of smelt, the supply of equal quantities is to be preferred. One of the tanks, for example tank II, is given a set point for the desired concentration of the final solution, while the liquid in the second tank, for example I, is given a lower set point. The solution, the green liquor, is then only withdrawn from the system from tank II. Most of the weak liquor is added to tank I, which has the lower set point. The pump 10 for the outlet from this tank is closed at this stage and all the liquid which is added to tank I will therefore flow into tank II via the line 3. The level in tank I will therefore be somewhat higher than in tank II in proportion to the flow resistance in the line 3. The quantities of weak liquor 6 which are to be added to the different tanks can easily be calculated and set automatically. The set point in tank I is expediently half of the set point in tank II, which means that the liquid which flows through the connecting line 3 is quite weak and does not give rise to any deposition of pirssonite.

The addition of weak liquor, which has been shown diagrammatically at 6, should take place via the outlet pumps 10, which are then operating in the opposite direction. This results in the outlet system being flushed and deposition being prevented.

In order to avoid the outlet systems becoming blocked, it is expedient, in accordance with the invention, for the functions of the tanks I and II to be switched over at regular intervals, for example once every twenty-four hours or once every shift. The opening which was previously the outlet for the concentrated, final solution then becomes the inlet opening for weak liquor. When alternating, the procedure is for the set point for the concentration in the tank from which pumping is to begin firstly to be adjusted to the value which pumped-out green liquor is to have. The flow of weak liquor to this tank will then decrease and perhaps cease for a period of time. When the desired concentration has been reached, the appurtenant green liquor pump is started at the same time as the other pump is stopped and the concentration set point of the corresponding tank is adjusted down to a lower level. The influx of weak liquor will then become greater than is otherwise the case for a period of time. The whole procedure can be automated and can be set in motion by an operation executed in the control room.

When the system according to the invention is used, the green liquor pumps provide complete backup for each other while, at the same time, the advantage is gained that the whole of each of the dissolver tanks, including the stirrer, is thoroughly washed at regular intervals with a weak green liquor, resulting in the dissolution of any deposits or encrustations. At the same time, the temperature will be altered, which can be advantageous for the cleaning process. Weak green liquor will, to all intents and purposes, always be flowing through the connecting pipe between the tanks, so that the risk of deposition taking place in this pipe can be regarded as being negligible. Should such deposition nevertheless occur, contrary to expectation, early indication of this fact will be obtained in the form of an increasing difference in level between the tanks.

Another advantage of the invention is that regulation of the concentration becomes more precise due to the step-wise addition of weak liquor.

EXAMPLE

The following is an example of running a plant according to the invention:

A recovery boiler for 3200 t of dry substance per twenty-four hours yields approximately 50 t of total titratable alkali per hour (50 tTTA/h). If the green liquor from the dissolver tanks, prior to final adjustment of the concentration, is assumed to be 175 kg of TTA/$m^3$, and the weak liquor contains 40 kg of TTA/$m^3$, the total weak liquor flow becomes 370 $m^3$/hour. The set point for the concentration in one of the tanks is adjusted to a value which corresponds to 120 kg of TTA/$m^3$. If the flow of smelt is divided equally between the two tanks, approximately 310 $m^3$ of weak liquor will then enter one of the tanks per hour, and the remainder will enter the other tank. The flow in the connecting pipe is also approximately 310 $m^3$/hour.

The invention is not limited to the embodiment which has been described, and can be varied in different ways within the scope of the patent claims.

We claim:

1. A process for dissolving smelt chemicals from recovery boilers, the process comprising the steps of:

providing a first dissolving tank having a bottom portion, the first dissolving tank containing a first resulting solution having a first concentration of smelt chemicals;

providing a second dissolving tank that is separate from the first tank, the second dissolving tank having a bottom portion, the second dissolving tank containing a second resulting solution having a second concentration of smelt chemicals;

providing supply devices for supplying smelt chemicals into the first and second dissolving tanks;

providing liquid supply members for supplying a dissolving liquid into the first and second dissolving tanks so that the smelt chemicals and the dissolving liquid form the resulting solutions disposed in the first and second dissolving tanks, the supply of dissolving liquid and smelt chemicals being dependent upon the concentration of the smelt chemicals in the resulting solutions;

providing a first outlet defined in the first dissolving tank for permitting the first resulting solution to flow out of the first dissolving tank;

providing a second outlet defined in the second dissolving tank for permitting the second resulting solution to flow out of the second dissolving tank;

providing a connector connected to the bottom portions of the first and second dissolving tanks so that the first dissolving tank is in fluid connection with the second dissolving tank;

providing a first shut off valve in operative engagement with the first outlet, the first shut off valve being movable between an open position that allows the first resulting solution to flow through the valve and a closed position that shuts off the flow of the first resulting solution;

providing a second shut off valve in operative engagement with the second outlet, the second shut off valve being movable between an open position that allows the second resulting solution to flow through the valve and a closed position that shuts off the flow of the second resulting solution, the second shut off valve being independently operative relative to the first shut off valve;

closing the first shut off valve and opening the second shut off valve;

setting a first set point of the concentration of the smelt chemicals in the first dissolving tank;

setting a second set point of the concentration of the smelt chemicals in the second dissolving tank;

conducting the first resulting solution to flow into the second tank when the second set point is greater than the first set point;

conducting the second resulting solution into the first tank when the first set point is greater than the second set point; and opening the first shut off valve and closing the second shut off valve.

2. A process for dissolving smelt chemicals according to claim 1 wherein the first set point is different from the second set point and the steps of setting the first and second set points include the step of switching a set point value of the first set point with a set point value of the second set point every twenty-four hours.

3. A process for dissolving smelt chemicals according to claim 1 wherein the steps of setting the set points include the step of setting the first set point twice as high as the second set point.

4. A process for dissolving smelt chemicals according to claim 1 wherein an approximately equal amount of smelt chemicals is supplied to the first and second dissolving tanks and a majority of the dissolving liquid is supplied to the first dissolving tank if the set point of the second dissolving tank is greater than the set point of the first dissolving tank.

5. A process for dissolving smelt chemicals according to claim 1 wherein the process further comprises the steps of changing the first set point of the first dissolving tank relative to the second set point of the second dissolving tank so that the flow of resulting solution through the connector is alternated and raising the set point of the first dissolving tank to a value that is the same as a value of the set point of the second dissolving tank by decreasing the supply of dissolving liquid to the first dissolving tank, opening the first shut off valve and closing the second shut off valve as the set point of the second dissolving tank is lowered and the inflow of dissolving liquid to the second dissolving tank is increased.

6. A process for dissolving smelt chemicals according to claim 1 wherein the step of alternating is performed automatically.

7. A process for dissolving smelt chemical comprising the steps of:

providing a first and a second tank in fluid communication with one another, the first tank having a first outlet and the second tank having a second outlet, the first outlet being closed and the second outlet being opened;

providing the first tank with a first concentration of green liquor and the second tank with a second concentration of green liquor, the second concentration being greater than the first concentration;

conveying the green liquid in the first tank into the second tank;

opening the first outlet and closing the second outlet;

increasing a supply of weak liquor into the second tank and reducing a supply of weak liquor into the first tank;

conveying green liquid in the second tank into the first tank;

increasing the first concentration of green liquor of the first tank to the second concentration; and reducing the second concentration of green liquor of the second tank to the first concentration of green liquor.

8. A device for dissolving smelt chemicals from recovery boilers, comprising:

a first dissolving tank having a bottom portion, the first dissolving tank containing a first amount of a first resulting solution having a first concentration of smelt chemicals;

a second dissolving tank that is separate from the first tank, the second dissolving tank having a bottom portion, the second dissolving tank containing a second amount of a second resulting solution having a second concentration of smelt chemicals, the first amount being greater than the second amount, the second concentration being greater than the first concentration;

supply devices for supplying smelt chemicals into the first and second dissolving tanks;

liquid supply members for supplying a dissolving liquid into the first and second dissolving tanks so that the smelt chemicals and the dissolving liquid form the resulting solutions disposed in the first and second dissolving tanks, the supply of dissolving liquid and smelt chemicals being dependent upon the concentrations of the smelt chemicals in the resulting solutions;

a first outlet defined in the first dissolving tank for permitting the first resulting solution to flow out of the first dissolving tank;

a second outlet defined in the second dissolving tank for permitting the second resulting solution to flow out of the second dissolving tank;

a connector connected to the bottom portions of the first and second dissolving tanks so that the first dissolving tank is in fluid connection with the second dissolving tank;

a first shut off valve in operative engagement with the first outlet, the first shut off valve being movable between an open position that allows the first resulting solution to flow through the valve and a closed position that shuts off the flow of the first resulting solution; and a second shut off valve in operative engagement with the second outlet, the second shut off valve being movable between an open position that allows the second resulting solution to flow through the valve and a closed position that shuts off the flow of the second resulting solution, the second shut-off valve being independently operative relative to the first shut off valve.

9. A device according to claim 8 wherein the device is a soda smelt dissolver.

10. A device according to claim 8 wherein the liquid supply members comprises an adjustment valve having one end connected to a common supply conduit and the other end connected to separate conduits for the first and second dissolving tanks.

11. A device according to claim 8 wherein each dissolving tank is provided with an outlet pump that is separately controllable.

12. A device according to claim 8 wherein the device comprises a bubble pipe measuring device for measuring the concentration of smelt chemicals and a level of resulting solution in the first and second dissolving tanks.

* * * * *